US006864468B2

(12) United States Patent
Kim et al.

(10) Patent No.: US 6,864,468 B2
(45) Date of Patent: Mar. 8, 2005

(54) ELECTRIC OVEN APPLYING AN INDUCTION HEATING AT BOTH SIDES OF THE CAVITY

(75) Inventors: Wan-Soo Kim, Gwaugmyeong (KR); Yang-Kyeong Kim, Bucheon (KR); Young-Min Lee, Incheon (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 10/429,831

(22) Filed: May 6, 2003

(65) Prior Publication Data

US 2004/0144773 A1 Jul. 29, 2004

(30) Foreign Application Priority Data

Jan. 23, 2003 (KR) ..... 10-2003-0004447

(51) Int. Cl.[7] ..... H05B 6/12; H05B 6/80

(52) U.S. Cl. ..... 219/601; 219/620; 219/680; 219/681; 219/685; 219/757

(58) Field of Search ..... 219/601, 620, 219/622, 624, 680, 681, 685, 715, 756, 757, 400

(56) References Cited

U.S. PATENT DOCUMENTS 3,790,735 A * 2/1974 Peters, Jr. ..... 219/622
4,585,923 A * 4/1986 Binder ..... 219/400
5,177,333 A * 1/1993 Ogasawara ..... 219/601
6,147,336 A * 11/2000 Ushijima et al. ..... 219/601

FOREIGN PATENT DOCUMENTS

JP 1-209691 * 8/1989 ..... 219/685
JP 2-306578 * 12/1990 ..... 219/685

* cited by examiner

*Primary Examiner*—Philip H. Leung
(74) *Attorney, Agent, or Firm*—Greenblum & Bernstein, P.L.C.

(57) ABSTRACT

Disclosed is an electric oven which increases temperature fast and reduces heat loss in accordance with that a cavity surface generates its own heat by using an induction heating. The electric oven comprises: a case having a door at a front side and having a cavity for receiving food therein; a magnetron installed at one side of an upper portion of the cavity for generating microwave of high frequency and supplying heat to the cavity; an inverter for generating high frequency at a space between the case and the cavity; first, second, third, and fourth heating units installed each side of the cavity for supplying heat. Since temperature of a cooking chamber can be set as wanted uniformly and faster, preheating time and actual cooking time can be reduced. Also, since inner temperature of the cavity rises faster and simultaneously, an automatic cleaning in the cavity using pyrolysis can be performed faster and uniformly, thereby reducing power consumption.

18 Claims, 4 Drawing Sheets

ELECTRIC OVEN APPLYING AN INDUCTION HEATING AT BOTH SIDES OF THE CAVITY

BACKGROUND OF THE INVENTION

1. Field of the Invention

The present invention relates to an electric oven, and more particularly, to an electric oven which increases temperature fast and reduces heat loss in accordance with that a cavity surface generates its own heat by using an induction heating.

2. Description of the Related Art

Generally, an electric oven is a cook used in the kitchen having its own heating means. The electric oven usually cooks food in a cooking chamber by using heat of an electric heater as a heating source, but sometimes uses microwave as a subsidiary heating source by mounting a magnetron.

FIG. 1 is a schematic perspective view showing a construction of an electric oven in accordance with the conventional art, in which a heater is mounted as a main heating source, and microwave is used as another heating source.

As shown, the conventional electric oven has a case 100 composed of a plurality of plates, which constitutes an appearance. For example, the electric oven can be composed of a plate for forming a lower surface thereof and cabinets for forming both sides and an upper surface thereof.

A cavity 200 into which food is put and cooking is performed is formed in the case 100.

The cavity 200 is selectively opened and closed by a door 130. A lower end of the door 130 is hinge-coupled to a front surface of the cavity 200, and a door handle 132 is formed at an upper end of the door 130. Accordingly, when the door handle 132 is pulled, the upper end is rotated downwardly on the basis of the lower end, thereby opening and closing the cavity 200. A managing unit 160 is provided at an upper end of the electric oven which is not shielded by the door 130. Generally, each kind of button required to manage the electric oven, and a display window for displaying an operation state of the electric oven can be formed at the managing unit 160.

A lower heater 112 is installed at a lower side of the cavity 200. The lower heater 112 generally uses a sheath heater. The lower heater 112 transmits heat to the cavity 200 through an inner bottom of the cavity 200.

An upper heater 110 is installed at an upper side of the cavity 200, which also uses the sheath heater, generally.

The sheath heater is composed of a metal pipe at an outer portion, a heat line located in the metal pipe, and an insulating material installed between the metal pipe and the heat line. The sheath heater is well know, thereby omitting its detail explanation.

In the meantime, a convection heater 114 is installed at a back side of the cavity 200. Also, a convection fan 140 is installed at the rear side of the cavity 200 where the convection heater 114 is installed. The convection fan 140 supplies air heated by the convection heater 114 to the cavity 200. To this end, a plurality of through holes 142 are formed at the back side of the cavity 200 corresponding to the convection heater 114.

A magnetron 150 for supplying heat to the cavity 200 as another heating source is formed at a space between an upper portion of the cavity 200 and the case 100. The magnetron 150 oscillates microwave and supplies heat to the cavity 200. The magnetron 150 supplies the microwave into a wave guide 152 mounted at the upper surface of the cavity 200. A reference numeral 144 denotes a cooling fan for cooling components including the magnetron 150. Other components for supplying the microwave will not be explained.

A reference numeral 180 denotes an oven lamp for lightening inside of a cooking chamber.

Operations of the conventional electric oven will be explained as follows.

Food is put on the cavity 200, the door 130 is closed, and a power source is supplied in a state that the cooking chamber is shielded from outside, thereby performing cooking. That is, when the power source is supplied, heat from the lower heater 112 is conducted to the bottom of the cavity 200. The conducted heat heats air in the cavity 200, and the heated air is transmitted to the food. Also, the upper heater 110 transmits heat to the food by radiation and convection, and the heat supplied from the convection heater 114 is transmitted to the cooking chamber as hot blast through the plurality of holes 142 by the convection fan 140 and transmitted to the food.

Meantime, the microwave oscillated from the magnetron 150 can be used to cook the food by the user's selection.

Hereinafter, problems of the conventional electric oven will be also explained.

The electric oven has to be heated in advance as a predetermined temperature before cooking. Also, in order to use an automatic cleaning function using pyrolysis in the cavity 200, an inner temperature of the electric oven has to be increased more than 500° C. and then considerable time has to lapse to combust oil of an inner wall.

The lower heater 112 and the upper heater 110 use the sheath heater. However, the sheath heater takes much time in increasing temperature up to a saturation temperature since specific heat is great. Also, since the lower heater 112 is not completely in contact with the lower surface of the cavity 200, contact heat resistance is great. Besides, heat efficiency is degraded by depending on natural convection having a low transmittance efficiency and the radiation which requires great temperature difference with the lower surface of the lower heater 112.

Also, another heat source does not exist at both sides of the cavity 200. Accordingly, said both sides of the cavity 200 are heated by heat conducted through the plates constituting the cavity 200 or heat transmitted by air flow in the cooking chamber. Eventually, since temperature of said both sides of the cavity 200 can be increased into a predetermined value after temperature of other parts is increased, much preheating time is required.

Accordingly, when cooking is to be performed or an outer surface of the cavity is to be cleaned, temperature of said both sides of the cavity 200 has to be increased more than temperature which is required for pyrolysis of other parts. As a result, consumption power is increased and a heatproof design becomes difficult.

SUMMARY OF THE INVENTION

Therefore, an object of the present invention is to provide an electric oven which can transmit heat of heat source to a cavity faster by applying an induction heating at both sides of the cavity.

According to this, preheating time or cooking time can be minimized, inner temperature of the entire cavity can be uniform, and cleaning for inside of the cavity using pyrolysis can be performed faster and more uniformly.

To achieve these and other advantages and in accordance with the purpose of the present invention, as embodied and broadly described herein, there is provided an electric oven comprising: a case having a door at a front side and having a cavity for receiving food therein; a magnetron installed at one side of an upper portion of the cavity for generating microwave of high frequency and supplying heat to the cavity; an inverter for generating high frequency at a space between the case and the cavity; a first heating unit installed right and left sides of the cavity for supplying heat to the cavity from the right and left sides; a second heating unit installed at an upper side of the cavity for supplying heat to the cavity from the upper side; a third heating unit installed at a lower side of the cavity for supplying heat to the cavity from the lower side; and a fourth heating unit installed at a back side of the cavity for supplying heat to the cavity from the back side.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
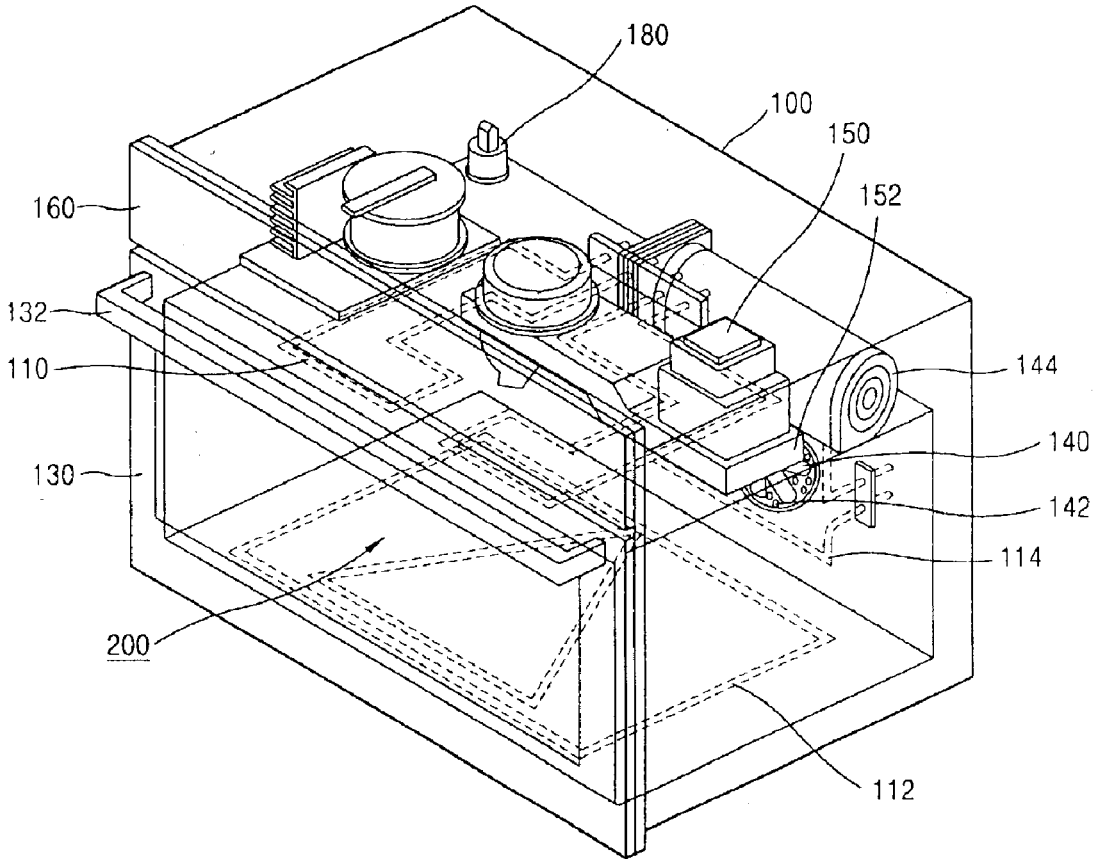
FIG. 1 CONVENTIONAL ART
FIG. 1 is a schematic perspective view showing a construction of an electric oven in accordance with the conventional art.
Figure 2:
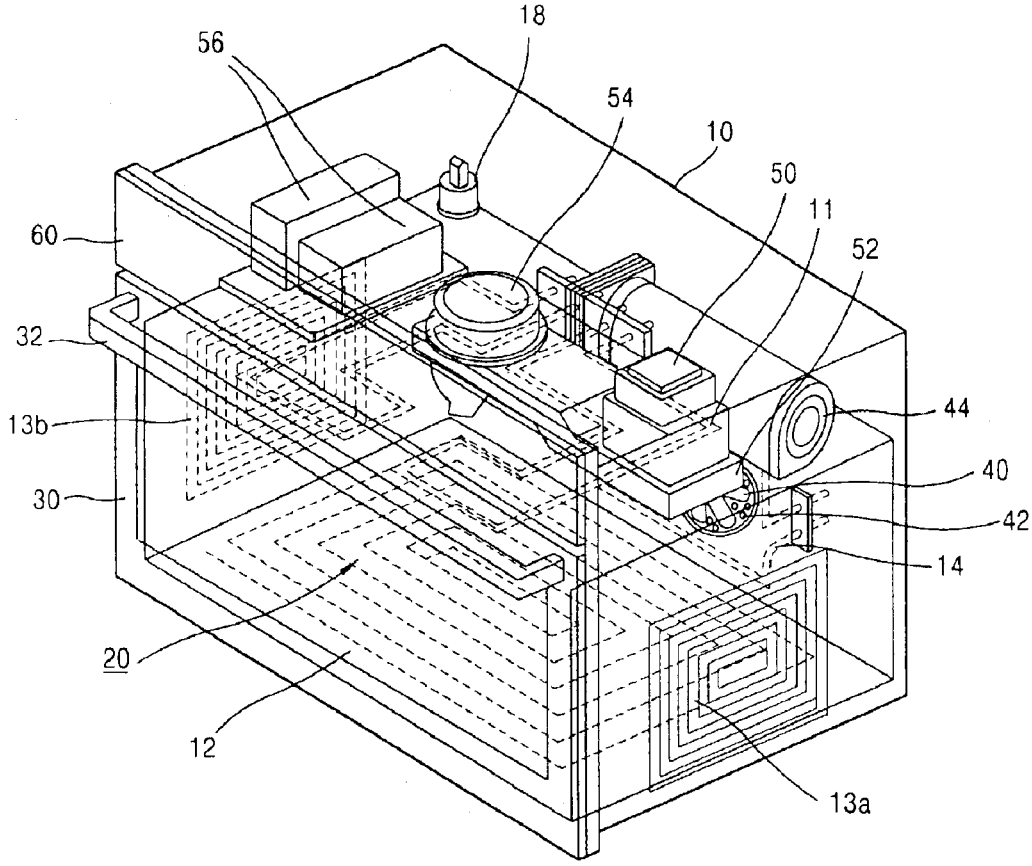
FIG. 2 is a schematic perspective view showing a construction of an electric oven according to one embodiment of the present invention.
Figure 3:
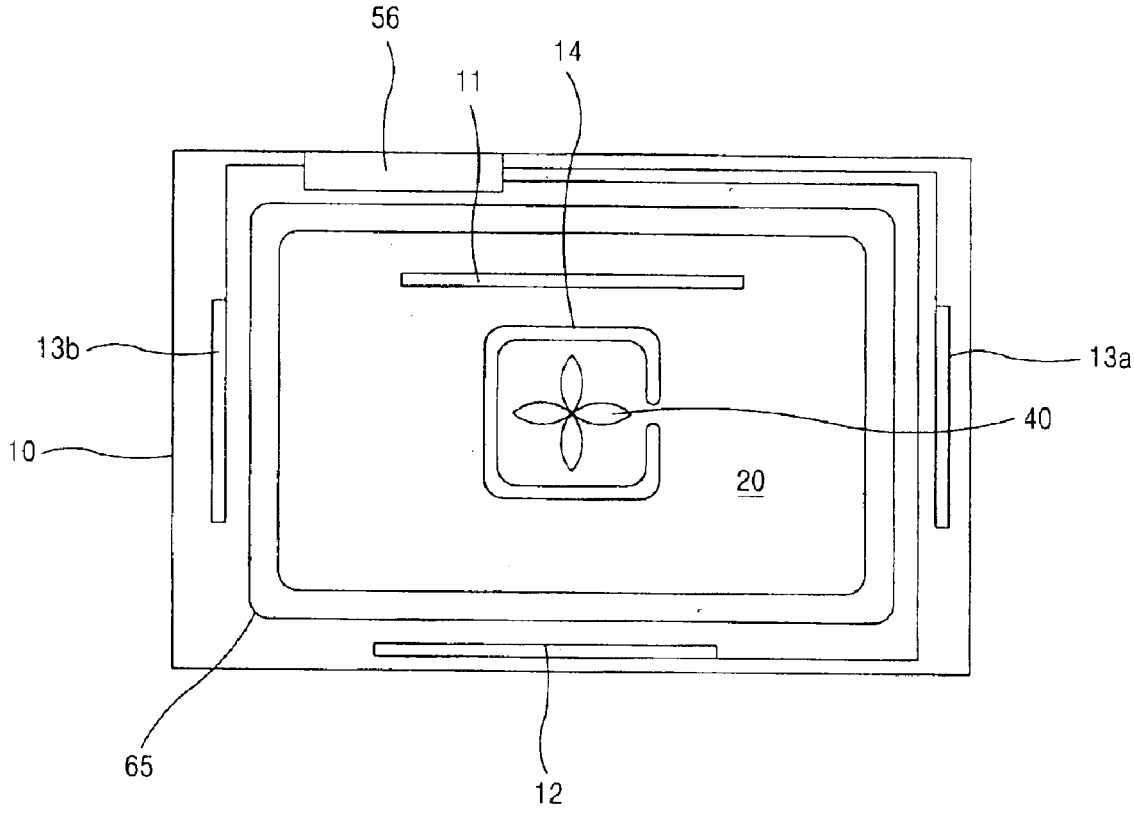
FIG. 3 is a longitudinal section view showing a position of a heating unit of FIG. 2.
Figure 4:
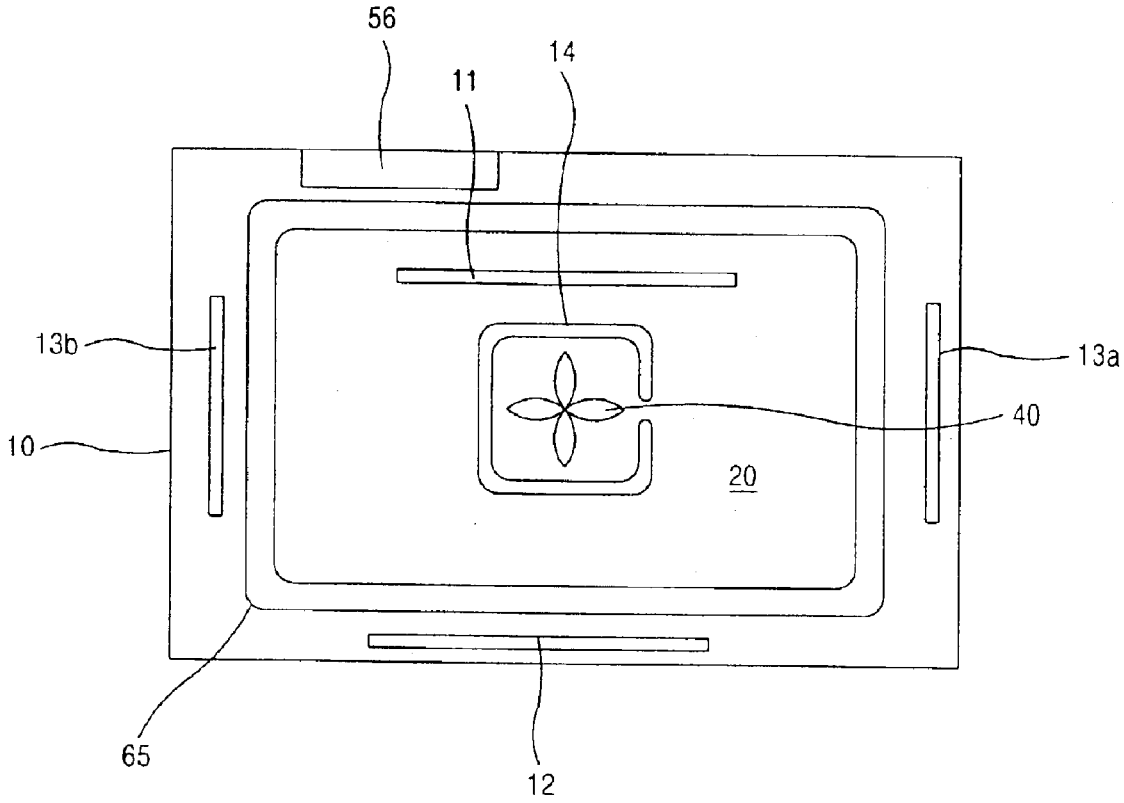
FIG. 4 is a longitudinal section view showing a position of the heating unit of FIG. 2 according to another embodiment.

FIG. 2 is a schematic perspective view showing a construction of an electric oven according to one embodiment of the present invention, FIG. 3 is a longitudinal section view showing a position of a heating unit of FIG. 2, and FIG. 4 is a longitudinal section view showing a position of the heating unit of FIG. 2 according to another embodiment.

As shown, an electric oven according to the present invention has a case 10 composed of a plurality of plates, which constitutes an appearance. For example, the electric oven can be composed of a plate for forming a lower surface thereof and cabinets for forming both sides and an upper surface thereof.

A cavity 20 into which food is put and cooking is performed is formed in the case 10. The cavity 20 is formed of a metal having a high thermal conductivity in order to generate heat through an induction heating at both sides thereof.

The cavity 20 is selectively opened and closed by a door 30. A lower end of the door 30 is hinge-coupled to a front surface of the cavity 20, and a door handle 32 is formed at an upper end of the door 30. Accordingly, when the door handle 32 is pulled, the upper end is rotated downwardly on the basis of the lower end, thereby opening and closing the cavity 20. A managing unit 60 is provided at an upper end of the electric oven which is not shielded by the door 30. Generally, each kind of button required to manage the electric oven, and a display window for displaying an operation state of the electric oven can be formed at the managing unit 60.

The electric oven according to the present invention is provided with heating units at every outside of the cavity 20 except a surface where the door is formed.

First heating units 13*a* and 13*b* are installed at right and left sides of the cavity 20. The first heating units 13*a* and 13*b* are provided with induction coil for induction heating.

The induction heating is performed by partially heating a metal having a high thermal conduction, or by using high frequency when only surfaces of a metal are to be heated.

To this end, both sides of the cavity 20 are formed with a metal having a thermal conduction.

A second heating unit 11 is installed at an upper side of the cavity 20, in which a sheath heater is mainly used like in the conventional art.

A third heating unit 12 is installed at a lower side of the cavity 20. The third heating unit can use the sheath heater like in the conventional art, or can use induction coil for induction heating. The third heating unit 12 supplies heat to the cavity 20 through an inner bottom of the cavity 20.

A fourth heating unit 14 is installed at a back side of the cavity 20. As the fourth heating unit, a convection heater is used. Also, a convection fan 40 is installed at the back side of the cavity 20 where the convection heater is installed. The convection fan 40 supplies air heated by the convection heater to the cavity 20. To this end, a plurality of through holes 42 are formed at the back side of the cavity 20 corresponding to the convection heater.

A magnetron 50 for supplying heat to the cavity 20 as another heating source is formed at a space between the upper portion of the cavity 20 and the case 10. The magnetron 50 oscillates microwave having high frequency and supplies heat to the cavity 20. The magnetron 50 supplies the microwave into a wave guide 52 mounted at the upper surface of the cavity 20.

Also, an inverter 56 for generating high frequency of 20~40 kHz is installed at a space between the upper surface of the cavity 20 and a corresponding surface.

A circuit of the inverter 56 can be shared together with a circuit of the magnetron.

FIG. 4 shows that the first heating unit 13*a* and 13*b*, the second heating unit 11, and the third heating unit 12 are constructed with only the sheath heater. At this time, too, the fourth heating unit 14 is constructed with the convection heater.

In the present invention, an insulating material 65 is further included between an outer side of the cavity 20 and the case 10 to prevent heat in the cavity 20 from being transmitted to the case.

A reference numeral 44 denotes a cooling fan for cooling components including the magnetron 50.

Also, an unexplained reference numeral 18 denotes an oven lamp for lightening inside of the cooking chamber.

Operations of the electric oven according to the present invention will be explained as follows.

Food is put on the cavity 20, the door 30 is closed, and a power source is supplied in a state that the cooking chamber is shielded from outside, thereby performing cooking. That is, when the power source is supplied, heat from the second heating unit 11 is transmitted to the food by radiation or convection. Also, heat from the convection heater is supplied to the cooking chamber as hot blast through the plurality of holes 42 by the convection fan 40 and transmitted to the food.

Meantime, the microwave oscillated from the magnetron 50 can be used to cook the food by the user's selection.

Also, the induction heating is performed at the induction coil formed at the lower side, and the right and left sides of the cavity 20 by using high frequency of 20~40 kHz generated from the inverter 56. According to this, temperature of said both sides of the cavity 20 is higher than that of any other surfaces.

Since the heating source is mounted at all outer sides except the surface where the door is formed, temperature of each surface of the cavity 20 rises equally.

The electric oven has to be preheated with a predetermined temperature before cooking. Also, in order to use an automatic cleaning function using pyrolysis in the cavity 20, an inner temperature of the electric oven has to be increased more than 500° C. and then considerable time has to lapse to combust oil of an inner wall.

Accordingly, in case that the preheating is performed in the oven, heat is supplied from the entire surface of the cavity 20, so that temperature of the entire cooking chamber can rise faster and uniformly. Besides, when heating is performed in a state that food is put in the cooking chamber after the preheating and the cooking chamber is shielded by the door, heat can be supplied to the food more uniformly.

Also, in case that the automatic cleaning function using pyrolysis to clean by combusting oil at the outer surfaces of the cavity 20, temperature of the inner surface of the cavity 20 rises equally, thereby performing the pyrolysis cleaning function more surely and faster.

Operations of the electric oven according to the present invention will be explained as follows.

Since the heat source is mounted at every space between the cavity and the corresponding surfaces in the electric oven, temperature of the cooking chamber can be set as wanted uniformly and faster.

Accordingly, preheating time and actual cooking time can be reduced, heat loss can be reduced, and thereby power consumption can be minimized.

Also, since the lower surface of the cavity and said both sides are operated as the heat source by using the induction heating, most of the generated heat can be used to cooking.

Especially, since temperature of the outer surface of the cavity rises faster and simultaneously when the cleaning is performed at the inner surface of the cavity by using the pyrolysis, the cleaning can be performed uniformly and temperature of a specific part is prevented from rising more than necessity.

Besides, in the present invention, the circuit for generating microwave and the circuit for induction heating can be shared, thereby reducing the number of components and using the components efficiently.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An electric oven comprising:

a case having a door at a front side and a cavity, the cavity receiving food therein;

a magnetron installed above the cavity, the magnetron generating microwave of high frequency and supplying heat to the cavity;

an inverter that generates high frequency at a space between the case and the cavity;

a first heating unit installed at right and left sides of the cavity, the first heating unit supplying heat to the cavity from the right and left sides;

a second heating unit installed at an upper side of the cavity, the second heating unit supplying heat to the cavity from the upper side;

a third heating unit installed at a lower side of the cavity, the third heating unit supplying heat to the cavity from the lower side; and a fourth heating unit installed at a back side of a cavity, the fourth heating unit supplying heat to the cavity from the back side.

2. The electric oven of claim 1, wherein the first heating unit is induction coil operated as an induction heating by high frequency generated from the inverter.

3. The electric oven of claim 2, wherein the third heating unit is induction coil operated as an induction heating by high frequency generated from the inverter.

4. The electric oven of claim 3, wherein right and left sides, and lower side of the cavity are formed with a metal having a high thermal conductivity in order to generate heat through the induction heating.

5. The electric oven of claim 3, wherein the fourth heating unit is a convention heater transmitting heat into a cooking chamber by heating air stream generated by a convection fan.

6. The electric oven of claim 5, wherein a circuit of the magnetron and a circuit of the inverter are shared.

7. The electric oven of claim 1, wherein the second heating unit is a sheath heater, and the first and third heating units are induction coil operated as an induction heating by high frequency generated from the inverters.

8. The electric oven of claim 7, wherein the fourth heating unit is a convection heater transmitting heat into a cooking chamber by heating air stream generated by a convection fan.

9. The electric oven of claim 8, wherein the inverter generates high frequency of 20~30 KHz bandwidth.

10. The electric oven of claim 1, further comprising an insulating material between an outer side of the cavity and the case to prevent heat in the cavity from being transmitted to the case.

11. The electric oven of claim 1, wherein a circuit of the magnetron and a circuit of the inverter are shared.

12. The electric oven of claim 1, wherein the first, second, and third heating units are sheath heaters.

13. The electric oven of claim 12, wherein the fourth heating unit is a convection heater for transmitting heat into a cooking chamber by heating air stream generated by a convection fan.

14. The electric oven of claim 1, wherein the inverter is installed above the cavity and adjacent of the magnetron.

15. The electric oven of claim 1, wherein the first heating unit increases the temperature of the right and left sides of the cavity to a temperature which is higher than that of any other surfaces.

16. The electric oven of claim 1, wherein the first heating unit preheats the cavity before cooking in order to use an automatic cleaning function using pyrolysis.

17. The electric oven of claim 16, wherein the first heating unit increases the temperature of the cavity to a temperature greater than 500° C.

18. An electric oven comprising:

a case having a door at a front side and a cavity, the cavity receiving food therein;

a magnetron installed above the cavity, the magnetron generating microwave of high frequency and supplying heat to the cavity;

an inverter that generates high frequency at a space between the case and the cavity;

a first heating unit installed at right and left sides of the cavity, the first heating unit supplying heat to the cavity from the right and left sides;

a plurality of additional heating units installed at upper, lower and back sides of the cavity, the additional heating units supplying heat to the cavity.

* * * * *

UNITED STATES PATENT AND TRADEMARK OFFICE

CERTIFICATE OF CORRECTION

PATENT NO. : 6,864,468 B2
DATED : March 8, 2005
INVENTOR(S) : W. S. Kim et al.

It is certified that error appears in the above-identified patent and that said Letters Patent is hereby corrected as shown below:

Column 6,
Line 39, "convention" should be -- convection --.
Line 67, "of" should be -- to --.

Signed and Sealed this

First Day of November, 2005

JON W. DUDAS
*Director of the United States Patent and Trademark Office*